US010124864B1

(12) United States Patent
Zarn et al.

(10) Patent No.: US 10,124,864 B1
(45) **Date of Patent: *Nov. 13, 2018**

(54) POP UP STORAGE SYSTEM FOR MARINE VESSELS

(71) Applicant: Brunswick Corporation, Lake Forest, IL (US)

(72) Inventors: Paul D. Zarn, Henning, MN (US); Kenneth D. Skillings, Wadena, MN (US); Terrance Weller, New York Mills, MN (US)

(73) Assignee: Brunswick Corporation, Mettawa, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/703,155

(22) Filed: Sep. 13, 2017

Related U.S. Application Data

(63) Continuation of application No. 15/235,861, filed on Aug. 12, 2016, now Pat. No. 9,796,456.

(51) Int. Cl.

| | |
|---|---|
| ***B63B 29/04*** | (2006.01) |
| ***A47B 88/00*** | (2017.01) |
| ***A47B 88/43*** | (2017.01) |
| ***A47B 88/46*** | (2017.01) |
| ***A47B 88/40*** | (2017.01) |

(52) U.S. Cl.
CPC ..... *B63B 29/04* (2013.01); *A47B 88/40* (2017.01); *A47B 88/43* (2017.01); *A47B 88/46* (2017.01)

(58) Field of Classification Search
CPC ..... B63B 29/04; A47B 88/08; A47B 88/0485; A47B 88/0481; A47B 88/40; A47B 88/43; A47B 88/46
See application file for complete search history.

(56) References Cited

U.S. PATENT DOCUMENTS

| | | | |
|---|---|---|---|
| 5,094,375 | A | 3/1992 | Wright |
| 5,235,723 | A | 8/1993 | Wallis |
| 5,407,261 | A | 1/1995 | Mercer |
| 5,975,002 | A | 11/1999 | Rieger |
| 6,447,068 | B1 | 9/2002 | Anderson et al. |
| 6,572,168 | B1 | 6/2003 | Radstake |
| 6,880,480 | B2 | 4/2005 | Clouse |
| 6,902,243 | B2 | 6/2005 | Bober |

(Continued)

OTHER PUBLICATIONS

Screen captures from YouTube video clip entitled "Lund 1875 Pro-V Bass Boat Review & Tour," 3 pages, uploaded Jun. 14, 2016 by user "Aj Lynn". Retrieved from Internet: <https://www.youtube.com/watch?v=PIMQL4O1u0s>. (Year: 2016).*

(Continued)

*Primary Examiner* — Anthony D Wiest
(74) *Attorney, Agent, or Firm* — Andrus Intellectual Property Law, LLP

(57) ABSTRACT

A pop up storage system for a boat having an opening formed in a deck includes a cabinet beneath the opening in the deck. A drawer is mounted for vertical sliding movement into and out of the cabinet and defines a storage compartment movable between an open position and a closed position. A motion assistance arrangement extends between the cabinet and the drawer, and is configured for assisting in movement of the drawer relative to the cabinet between a raised position and a lowered position.

9 Claims, 10 Drawing Sheets

(56) References Cited

U.S. PATENT DOCUMENTS

| | | | | |
|---|---|---|---|---|
| 8,033,620 | B2 * | 10/2011 | Retchloff ..... | B25H 3/04 312/290 |
| 8,616,143 | B2 | 12/2013 | Hancock, Jr. et al. | |
| 2006/0261714 | A1 | 11/2006 | Hazzard | |
| 2008/0041287 | A1 | 2/2008 | Toupin | |
| 2014/0144362 | A1 | 5/2014 | Atkinson | |
| 2017/0295264 | A1 | 10/2017 | Touitou et al. | |

OTHER PUBLICATIONS

Screen captures from Wired2Fish.com entitled "Lund Unveils New Bass Boat" 2 pages, uploaded Aug. 28, 2015 by "The Editors". Retrieved form the internet: < https://scout.conn/outdoors/bass-fishing/Article/Lund-Unveils-New-Bass-Boat-101451745/ (Year: 2015).*

* cited by examiner

POP UP STORAGE SYSTEM FOR MARINE VESSELS

CROSS REFERENCE TO RELATED APPLICATION

This application is a continuation of U.S. patent application Ser. No. 15/235,861, filed Aug. 12, 2016, which is incorporated herein by reference in entirety.

FIELD

The present disclosure relates to marine vessels and watercraft, and more particularly, pertains to a pop up storage system for providing a storage compartment which may be more easily moved up and down relative to the deck of a boat between open and closed positions, and which may be more ergonomically accessed by an operator of the boat from above the deck.

BACKGROUND

Various type of watercraft, such as fishing boats and other recreational boats have storage compartments for storing life preservers, fishing gear, such as tackle boxes and fishing rods, recreational equipment and other accessories. Such storage compartments are provided below bow and stern portions of the deck, and are typically opened and closed from above the deck by raising and lowering access doors or covers movably connected, such as by hinges, to deck structure. In some cases, assist devices, such as gas or air cylinders, are mounted between the access doors and the upper structure of the storage compartment to assist a user in moving an access door between an open position and a closed position when it is desired to selectively access the stored items.

Prior art storage compartments have been found to be unsatisfactory because they require a user to bend over and/or reach beneath the deck to retrieve or place storage items in the storage compartment once the access door has been opened.

Accordingly, the present inventors have found that it is desirable to provide a storage system having a storage compartment which is designed to pop up and be located so access to stored items can be obtained above the deck without bending over or reaching into the storage compartment beneath the deck.

SUMMARY

This Summary is provided to introduce a selection of concepts that are further described herein below in the Detailed Description. This Summary is not intended to identify key features or essential features of the claimed subject matter, nor is it intended to be used in limiting the scope of the claimed subject matter.

According to certain examples, a pop up storage for a boat having an opening formed in a deck includes a cabinet extending through the opening beneath the deck and fixed thereto. A drawer is mounted for vertical sliding movement into and out of the cabinet, and defines a storage compartment movable between an open position and a closed position. A motion assistance arrangement extends between the cabinet and the drawer, and is configured for assisting in movement of the drawer relative to the cabinet between a raised position and a lowered position.

According to some examples, a pop up storage system for a boat having an opening formed in a deck includes a cabinet extending through the opening beneath the deck and fixed relative thereto. A drawer is mounted for vertical movement into and out of the cabinet and defines a storage compartment movable between an open position and a closed position. A slide arrangement is provided between the cabinet and the drawer on opposite sides thereof and is configured for enabling sliding of the drawer relative to the cabinet. A motion assistance arrangement extends between the cabinet and the drawer, and is configured for assisting in movement of the drawer between a raised position and a lowered position relative to the cabinet and automatically retaining the drawer in the cabinet in the lowered position.

According to further examples, a boat includes a hull, a deck having an opening formed therethrough and an operator station having at least one seat. A pop up storage system is formed between the hull and the deck, the pop up storage system including a cabinet extending through the opening beneath the deck and fixed in supporting relationship thereto. A drawer is mounted for vertical sliding movement into and out of the cabinet, and defines a storage compartment movable between an open position and a closed position. A slide arrangement is provided between the cabinet and the drawer on opposite sides thereof. An over-center biasing arrangement is provided between bottom surfaces of the cabinet and the drawer, and is configured for assisting in movement of the drawer between a raised position and a lowered position relative to the cabinet, and automatically retaining the drawer in the cabinet in the lowered position.

BRIEF DESCRIPTION OF THE DRAWINGS

The present disclosure references the following Figures. The same numbers are used throughout the Figures to reference like features and like components.

DETAILED DESCRIPTION

Figure 1:
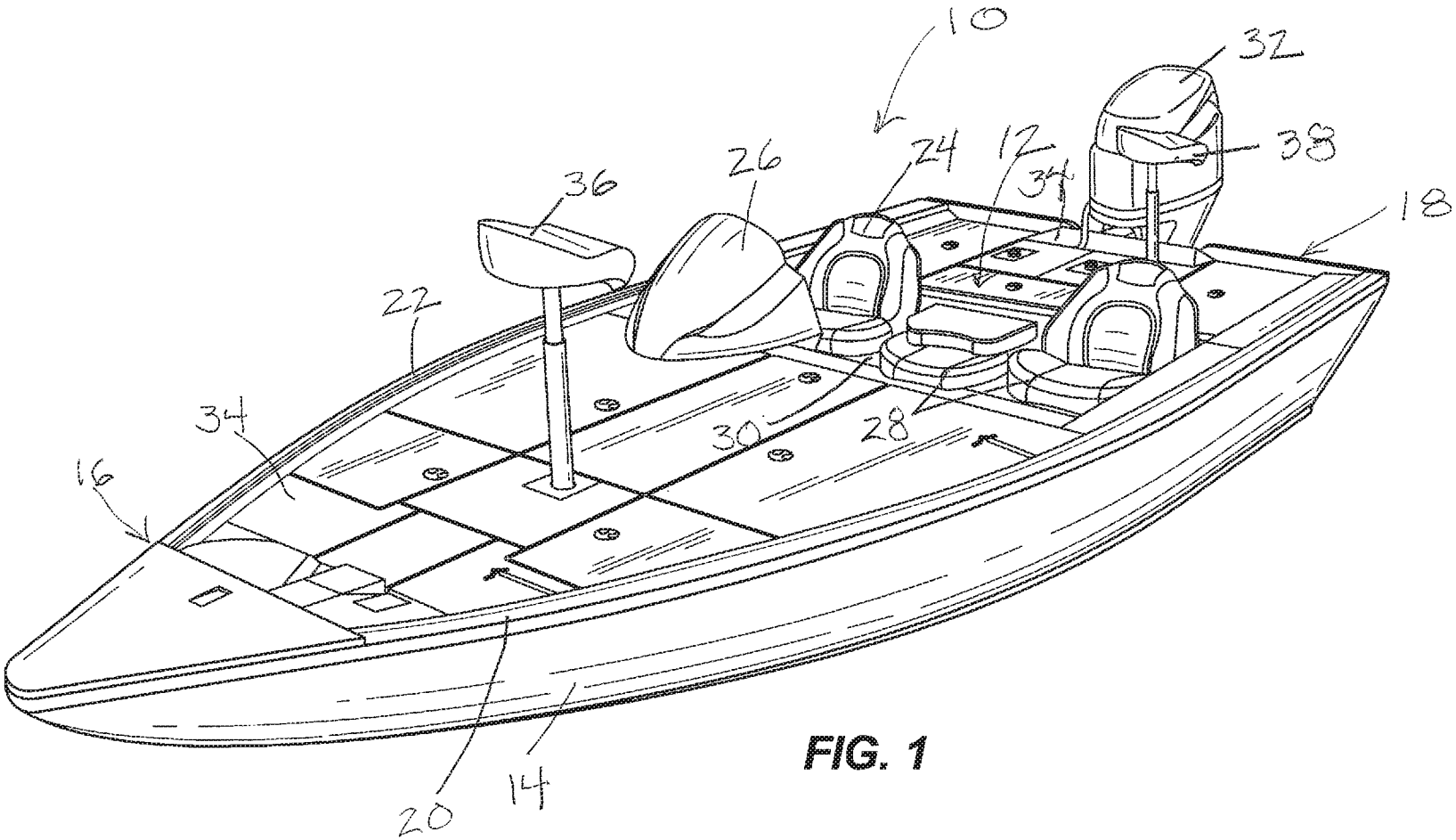
FIG. 1 is a perspective view of a boat incorporating a pop up storage system in accordance with the present disclosure.

FIG. 1 illustrates a watercraft, such as a fishing boat 10, constructed with a pop up storage system 12 in accordance with an exemplary embodiment of the present disclosure.

The fishing boat 10 has a hull 14 with a bow 16 and a stern 18, and respective port and starboard gunwales 20, 22. An operator seat 24 is provided with an operator console 26 and is mounted along with one or more passenger seats 28 in a cockpit/operator station 30 between the bow 16 and the stern 18. The fishing boat 10 also includes an outboard motor 32 situated at the center of the stern 18. The bow 16 and stern 18 each have a deck 34 which typically provides a raised platform to facilitate casting, such as from elevated seats 36, 38 which are mounted on pedestals rising from the bow 16 and the stern 18.

Figure 2:
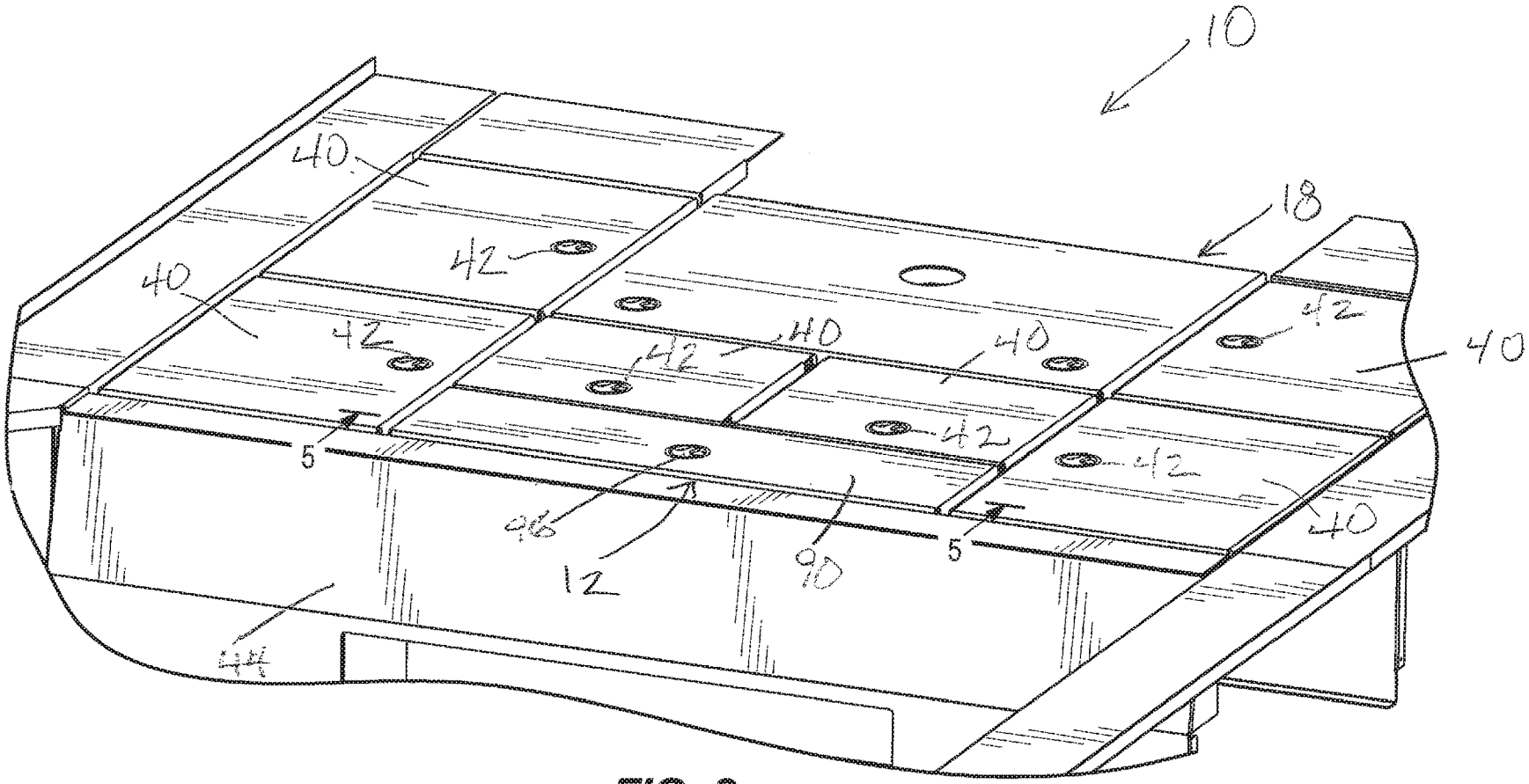
FIG. 2. is an enlarged fragmentary perspective view of a stern of a boat of FIG. 1 showing access doors of various storage compartments, one of which includes the pop up storage system in a lowered position.

As seen in FIG. 2, the stern 18 of the fishing boat 10 is provided with a number of access doors 40 which are each shown held in a closed locked position by a latching device 42 so that the access doors 40 are in covering relationship for preventing access to a group of storage compartments (not shown) formed between the hull 14 and the deck 34. As is well known, the access doors 40 are typically hingedly mounted to the deck 34 and can be moved between a raised and unlocked open position and the lowered closed and locked position shown. In the open position, a user bends over/or reaches down into the recessed storage compartment when it is desired to retrieve or add/replace one or more items in the storage compartment. The storage compartments provided with the access doors 40 may be used for dry storage or for wet storage, such as a live well which is positioned behind the pop up storage system 12.

Figure 3:
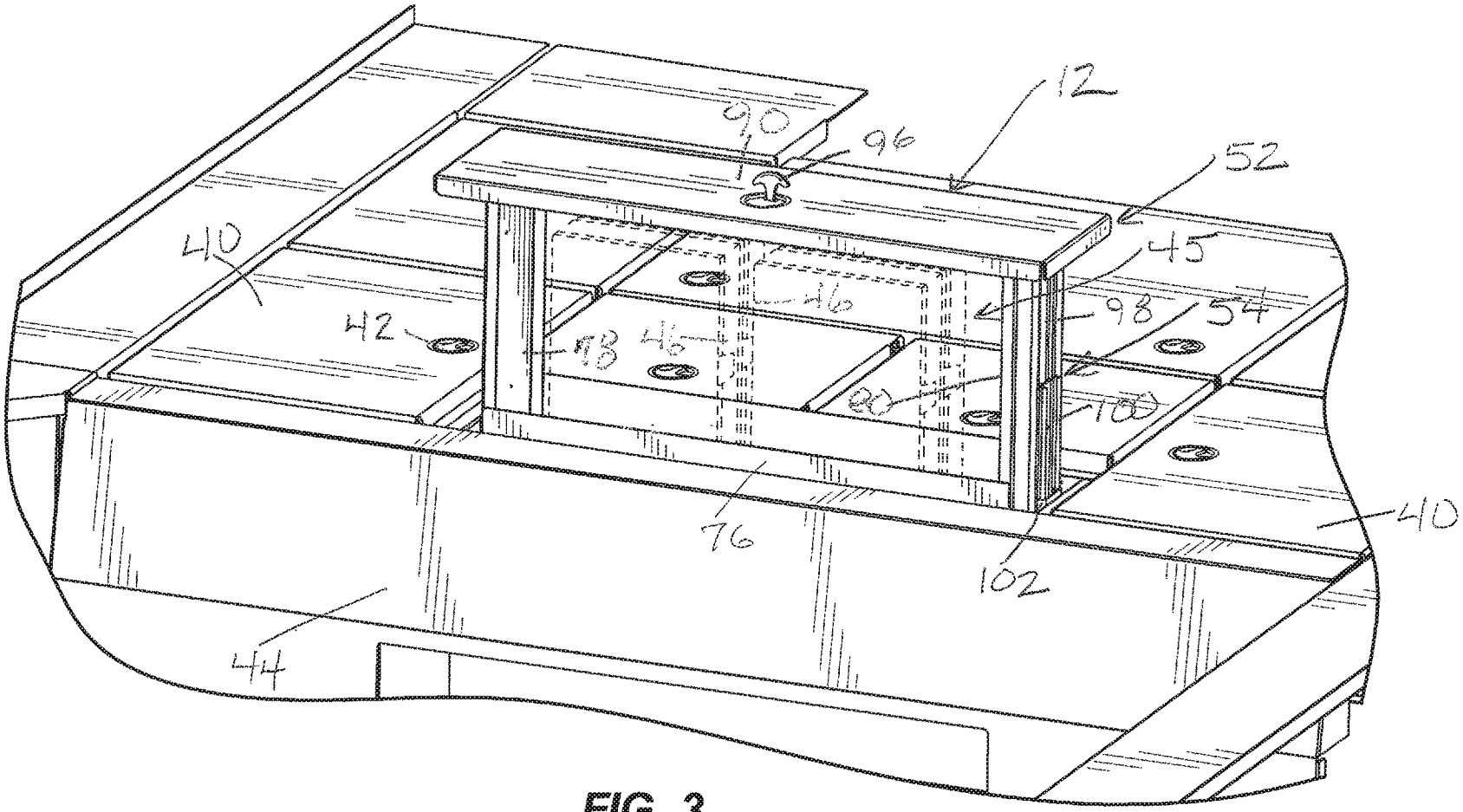
FIG. 3 is a view similar to FIG. 2 showing the pop up storage system in a raised position.
Figure 5:
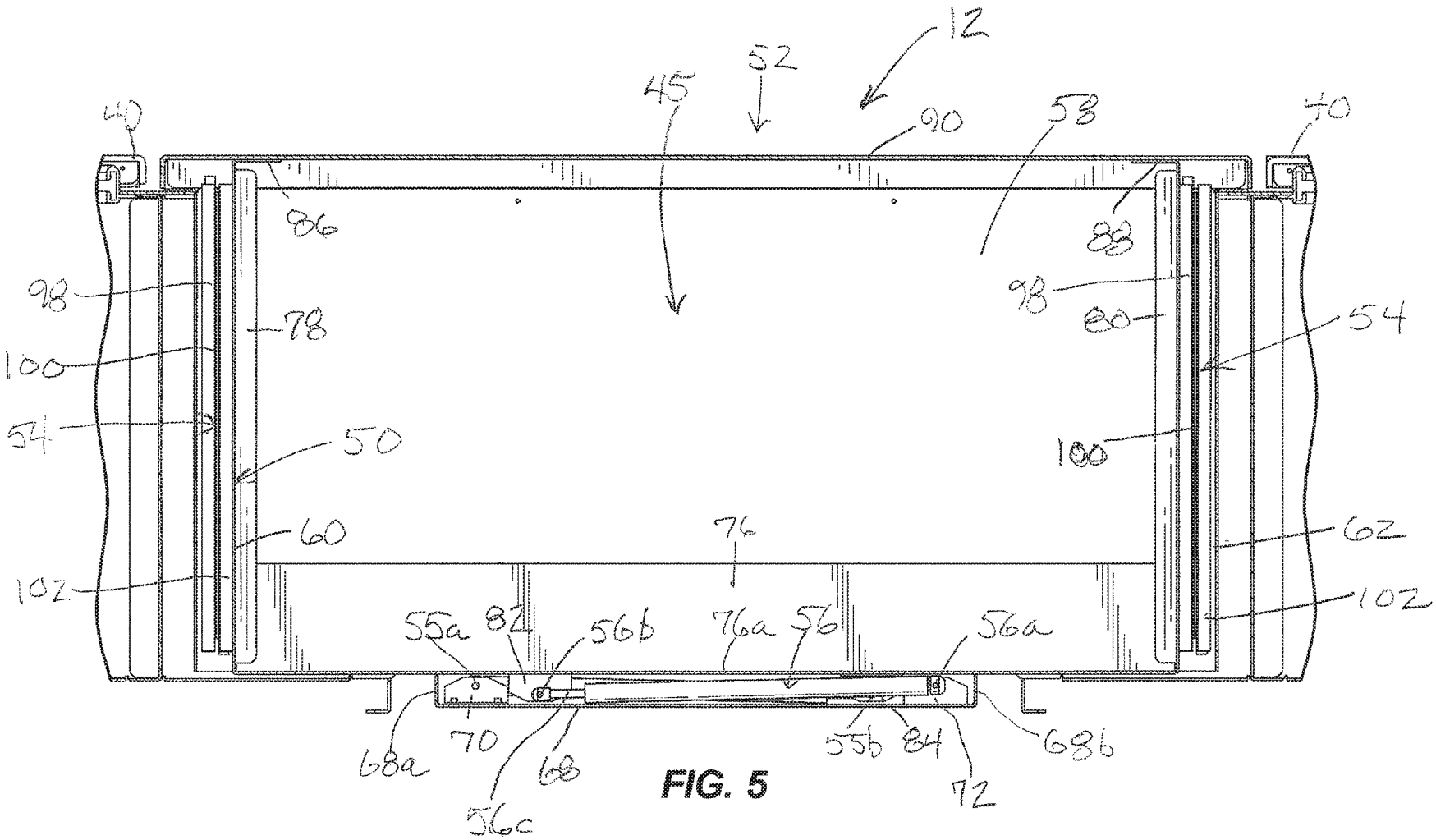
FIG. 5 is a sectional view of the pop up storage system in the lowered position as taken on line 5-5 of FIG. 2.
Figure 6:
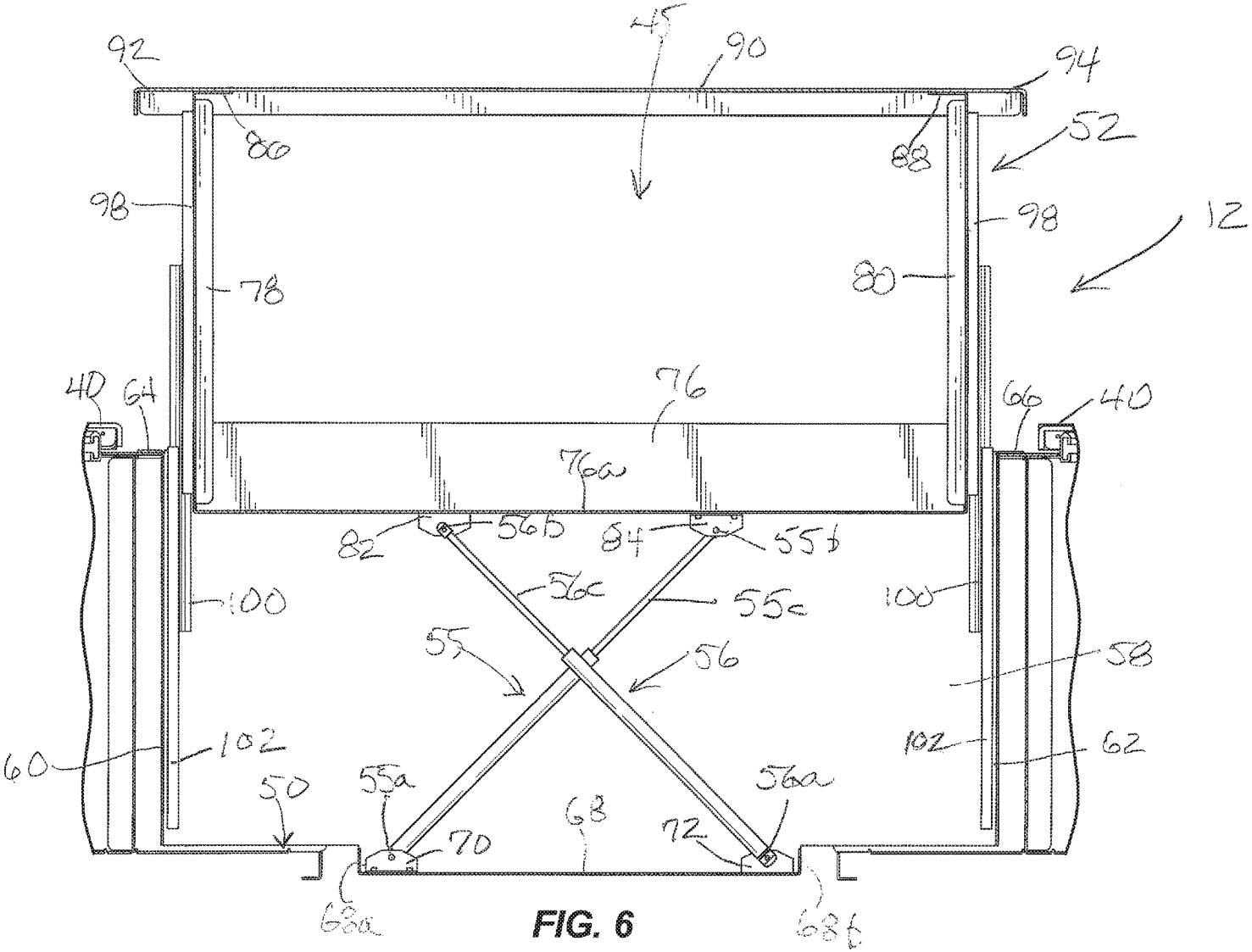
FIG. 6 is a view similar to FIG. 5 showing the pop up storage system in the raised position.

In contrast with the recessed storage compartments covered by the hingedly mounted access doors 40, the present disclosure provides the pop up storage system 12 which is positioned for assisted vertical movement between a lowered position shown in FIGS. 2 and 5, and a raised position shown in FIGS. 3 and 6. The pop up storage system 12 is centrally located in the stern 18 immediately adjacent and behind a rear bulkhead 44 of the cockpit/operator station 30 to provide easy access to a user seated in the cockpit/operator station 30. The pop up storage system 12 is configured to define a storage compartment 45 for holding and organizing a plurality of removable items, such as a set of tackle boxes 46 represented by the phantom lines of FIG. 3.

Figure 4:
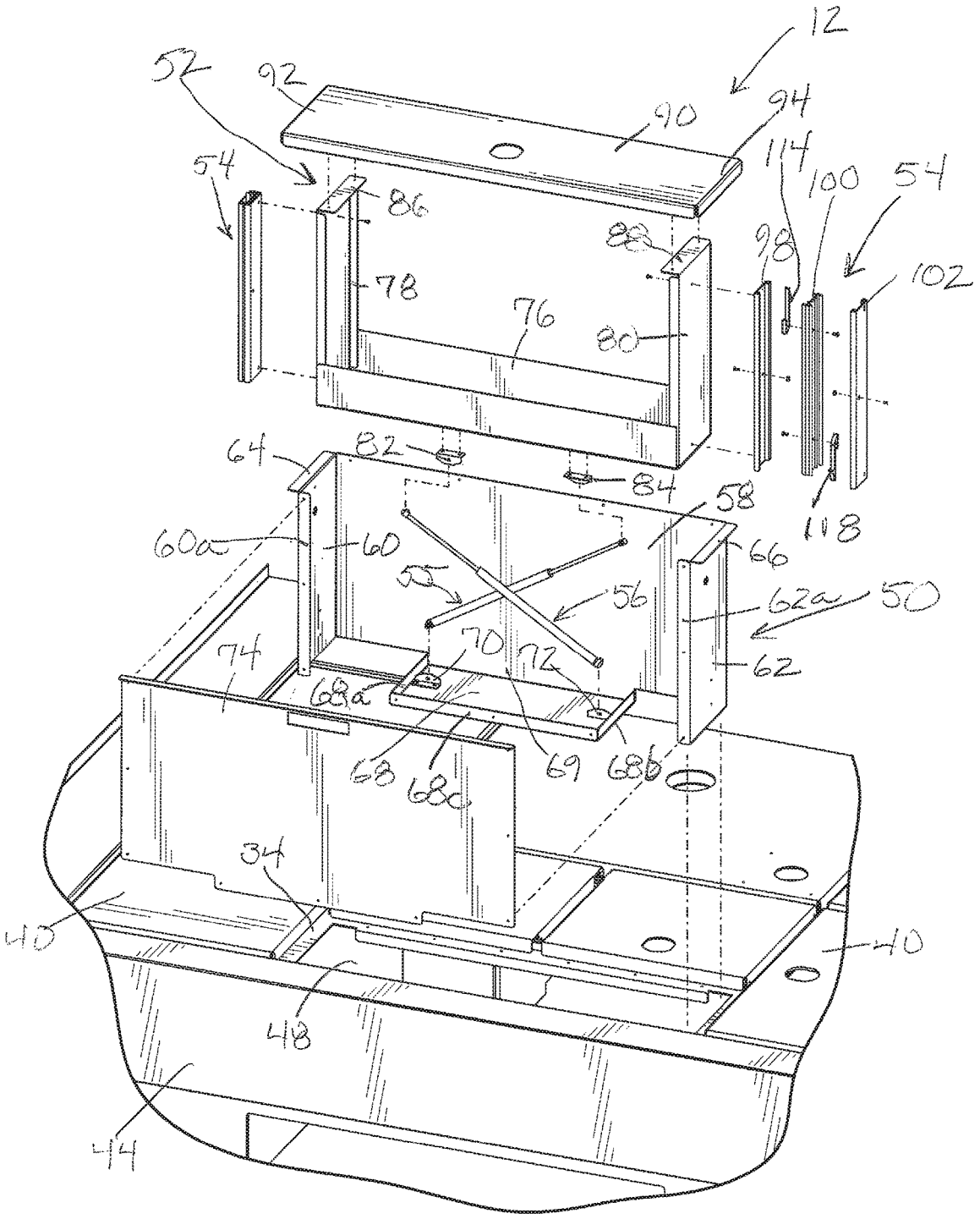
FIG. 4 is an exploded view of the pop up storage system.

Referring now to FIG. 4, the pop up storage system 12 is mounted in an opening 48 formed in the deck 34 and extending into the hull 14 behind the rear bulkhead 44. The pop up storage system is comprised of a cabinet 50 extending beneath the deck 34, a drawer 52 mounted for vertical movement relative to the cabinet 50, a slide arrangement formed by a pair of slide assemblies 54 positioned between the cabinet 50 and the drawer 52, and a movement assistance arrangement in the exemplary form of a pair of extendable and retractable gas struts 56 illustrated between bottom surfaces of the cabinet 50 and the drawer 52. Other suitable motion assistance arrangements, such as gas springs, or electric, hydraulic or pneumatic actuators, are further contemplated by the present disclosure.

The cabinet 50 includes a rear wall 58 integrally constructed with opposed cabinet side walls 60, 62 having respective outwardly extending upper ledges 64, 66. The ledges 64, 66 are configured to be suitably fixed to the peripheral area of the deck 34 defining the opening 48 so that the cabinet 50 is secured beneath the deck 34. A recessed mounting surface 68 projects forwardly from a depending central bottom portion 69 (FIG. 4) of the rear wall 58, and includes a pair of mounting brackets 70, 72 fixed thereto and projecting upwardly therefrom. Side edges 68*a*, 68*b* and front edge 68*c* extend upwardly from the recessed mounting surface 68. A front wall 74 extends across and is fastened to front edges 60*a*, 62*a* of the cabinet side walls 60, 62 and the front edge 68*c* of the recessed mounting surface 68.

The drawer 52 is configured to slide up and down relative to the cabinet 50 between the lowered position (FIG. 5) and the raised position (FIG. 6), and includes a base 76 having a pair of opposed side panels 78, 80. A lower surface 76*a* of the base 76 is provided with a pair of mounting brackets 82, 84 fixed thereto. With the drawer 52 in the lowered position of FIG. 5, the lower surface 76*a* of the base 76 lies above the recessed mounting surface 68. The opposed side panels 78, 80 have respective inwardly extending projections 86, 88 for supporting and fixedly mounting an access door 90 thereto. The access door 90 has opposed ends 92, 94 which are designed to be engaged and disengaged with the ledges 64, 66 of the cabinet 50. As seen in FIG. 3, the access door 90 is provided with a handle 96 used in operation of the pop up storage system 12.

Figure 7:
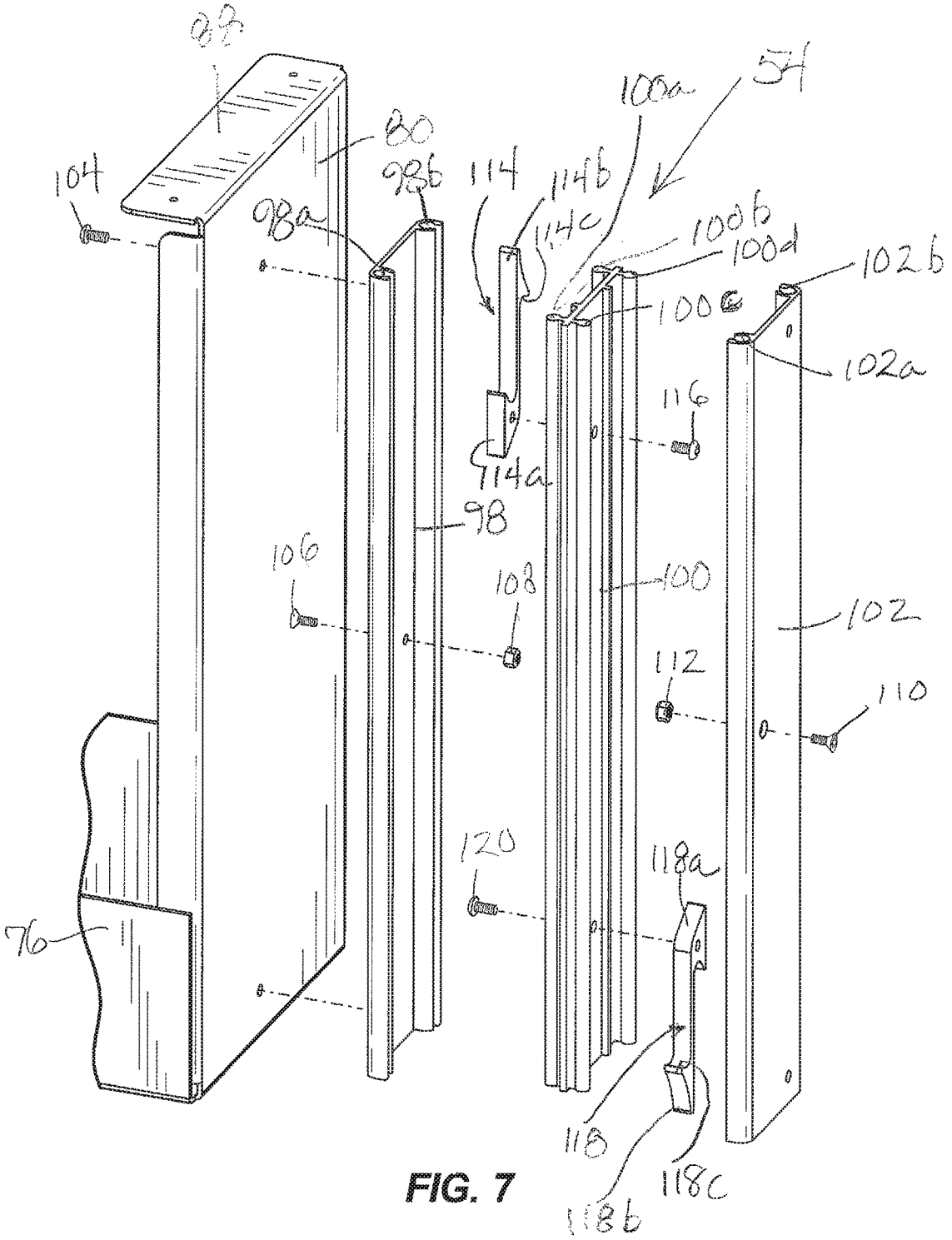
FIG. 7 is an exploded view of a slide arrangement used in the pop up storage system.

The slide assemblies 54 are designed to provide sliding vertical movement and travel limits of the drawer 52 relative to the cabinet 50. The slide assemblies 54 are configured to be positioned between the inside surfaces of the cabinet side walls 60, 62 and the outside surfaces of the drawer side panels 78, 80. FIG. 7 illustrates a slide assembly 54 positioned relative to the side panel 80 of the drawer 52 and the description to follow is identical for the slide assembly 54 positioned on the opposite side panel 78 of the drawer 52. The slide assembly 54 includes an inner member 98, an intermediate member 100 and an outer member 102. The inner member 98 is fastened such as by a top screw 104 and a bottom screw (not shown) to the outer surface of the side panel 80 of the drawer 52. An intermediate screw 106 is fastened to the inner member 98 and secured to a nut 108. The inner member 98 has opposed tracks 98*a*, 98*b* for guiding a pair of rods 100*a*, 100*b* on the intermediate member 100. The outer member 102 has opposed tracks 102*a*, 102*b* for slidably receiving rods 100*c*, 100*d* on the intermediate member 100. An intermediate screw 110 is fastened to the outer member 102 by a nut 112. The nuts 108 and 112 define stop members configured for engagement and disengagement with engagement members in the form of clips to be described below.

Figure 8:
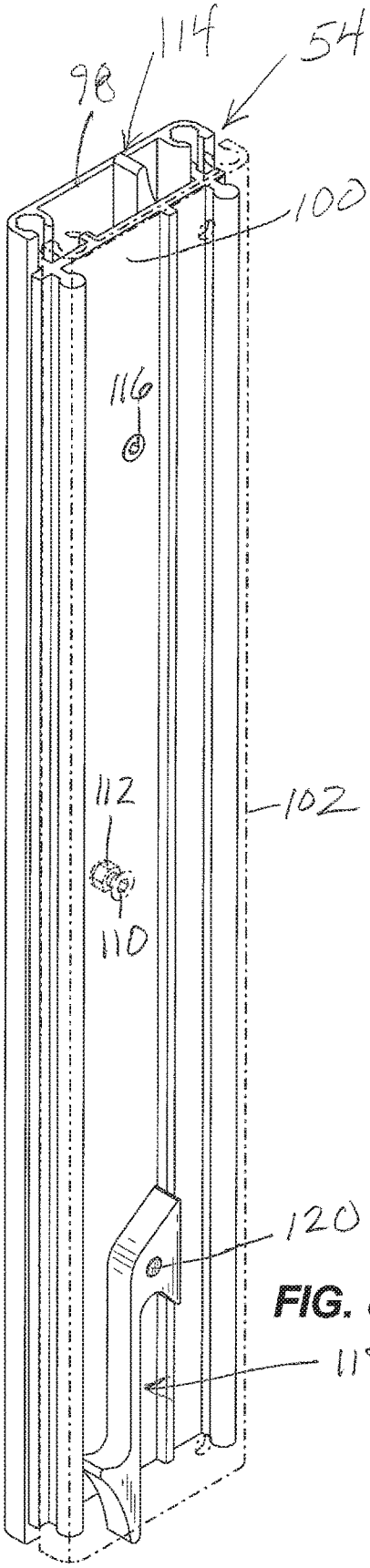
FIG. 8 is a perspective view of the assembled slide arrangement in a retracted position.
Figure 9:
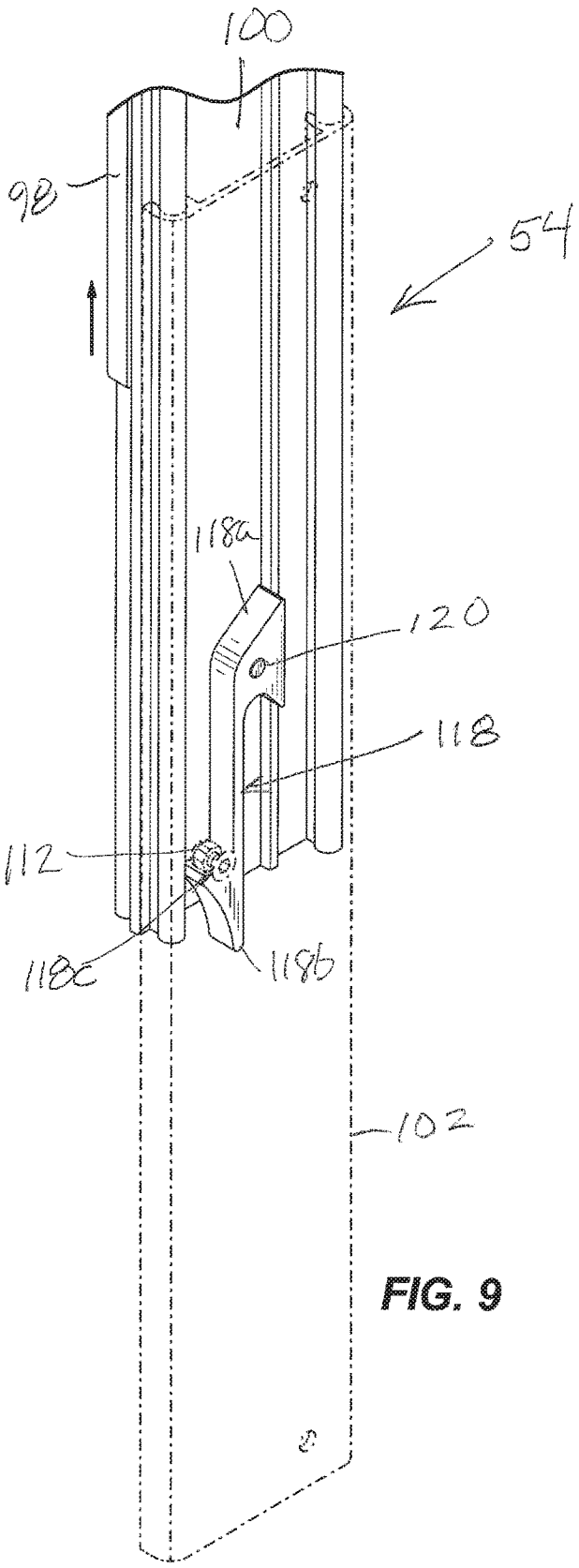
FIG. 9 is a perspective view depicting the slide arrangement in an extended position.
Figure 13:
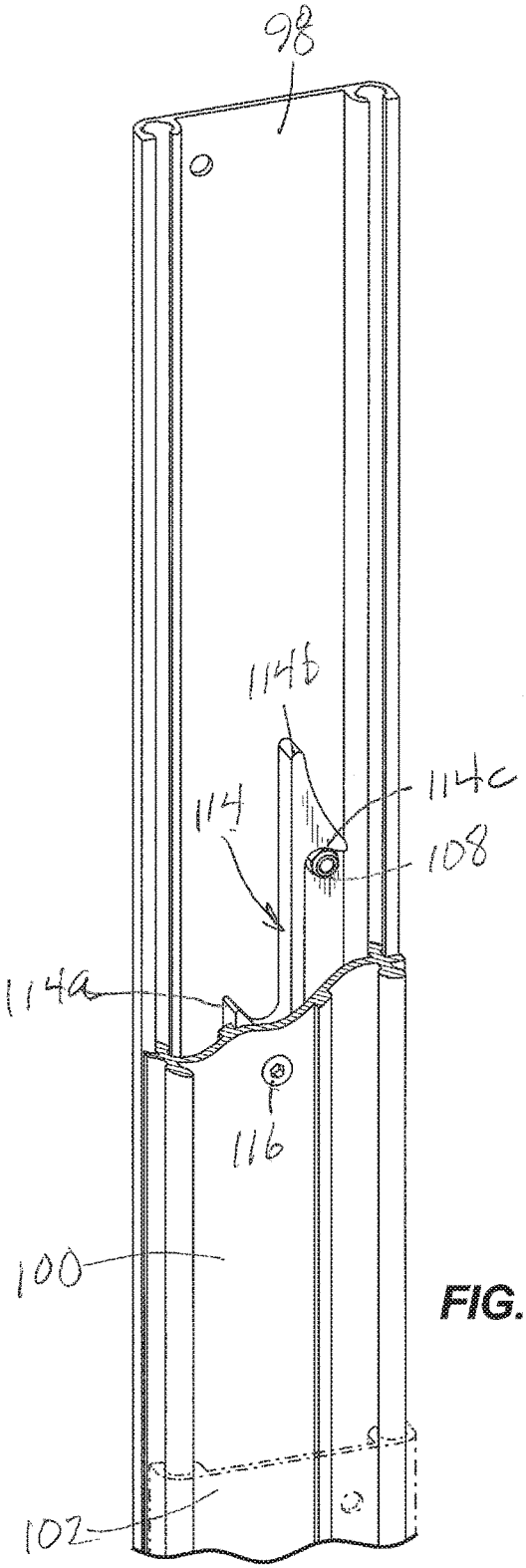
FIG. 13 is a perspective view depicting the slide arrangement in a partially extended position.

An upper resilient clip 114 is joined by a screw 116 between the inner member 98 and the intermediate member 100. A lower resilient clip 118 is mounted by a screw 120 between the intermediate member 100 and the outer member 102. The upper and lower resilient clips 114, 118 are provided to establish limits of upward travel of the drawer 52 relative to the cabinet 50 as will be better understood below. In addition, upper and lower resilient clips 114, 118 are formed of a resilient material which will enable disassembly of the slide assemblies 54 when desired as will also be more fully discussed below. As seen in FIG. 13, the upper resilient clip 114 has a mounting end 114*a* fastened by the screw 116 to an inner surface of the intermediate member 100, and an engagement end 114*b* having a notch 114*c* configured for engagement and disengagement with the nut 108 positioned on the outer surface of the inner member 98. The lower resilient clip 118 is identical in structure to the upper resilient clip 114, but is reversely oriented. As seen in FIG. 9, the lower resilient clip 118 has a mounting end 118*a* fastened by the screw 120 to an outer surface of the intermediate member 100, and an engagement end 118*b* having a notch 118*c* configured for engagement and disengagement with the nut 112 positioned on an inside surface of the outer member 102. FIG. 8 represents a full retraction of the slide assemblies 54 when the drawer 52 is in the lowered position as shown in FIG. 5. FIG. 9 represents a full extension of the slide assemblies 54 when the drawer 52 is moved to the raised position as shown in FIG. 6 and as will be described in more detail below in cooperation with the operation of the gas struts 55, 56.

Referring now to FIGS. 4-6 the gas struts 55, 56 are designed as an over-center biasing arrangement to assist in the raising and lowering of the drawer 52 relative to the cabinet 50, and to automatically retain the drawer 52 in the lowered position shown in FIG. 5. Gas strut 55 has a casing end pivotally mounted about a fixed pivot axis 55*a* to the mounting bracket 70, and a rod end pivotally coupled about a moving pivot axis 55*b* to the mounting bracket 84. Gas strut 56 has a casing end swingably joined about a fixed pivot axis 56*a* to the mounting bracket 72, and a rod end swingably fastened about a moving pivot axis 56*b* to the mounting bracket 82.

As seen in FIG. 5 with the drawer 52 lowered within the cabinet 50, the gas struts 55, 56 lie collapsed one behind the other in substantially parallel relationship within the recessed mounting surface 68 such that rods 55*c*, 56*c* of the gas struts 55, 56 are oriented at a slight downward angle relative to the lower edge 76*a* of the base 76. This orientation causes the rods 55*c*, 56*c* of the gas struts 55, 56 to push outwardly and downwardly such that the drawer 52 is automatically retained within the cabinet 50 in the position of FIG. 5 without the need for any other retaining mechanisms at or below the deck 34. In this orientation, the moving pivot axis 56*b* of the gas strut 56 lies beneath the fixed pivot axis 56*a*, and the moving pivot axis 55*b* of the gas strut 55 lies beneath the fixed pivot axis 55*a*. In FIG. 5, the fixed pivot axes 55*a*, 56*a* and the moving pivot axes 55*b*, 56*b*, all lie beneath a horizontal plane extending across the top of edges 68*a*, 68*b*, and 68*c* of recessed mounting surface 68.

In use, when it is desired to move the drawer 52 from the lowered position and the storage compartment 45 from the closed position of FIG. 5, a user in the cockpit/operator station 30 can turn towards the stern 18 and grasp the handle 96 which is easily within reach adjacent the rear bulkhead 44 as seen in FIG. 2. With a momentary light manual pull on the handle 96, the drawer 52 is slightly raised within the cabinet 50 and the gas struts 55, 56 provide an over-center biasing function causing the moving pivot axes 55*b*, 56*b* to swing above the fixed pivot axes 55*a*, 56*a* and the horizontal plane extending across the edges 68*a*, 68*b*, 68*c* of the recessed mounting surface 68. As a result, the drawer 52 is free to move and the rods 55*c*, 56*c* are forcibly extended from the gas struts 55, 56 enabling the lifting of the drawer 52 to the raised position and the movement of the storage compartment 45 to the open position shown in FIG. 6. In the raised position of the drawer 52, the gas struts 55, 56 lie angularly disposed relative to one another.

At the same time, the slide assemblies 54 move from the collapsed position shown in FIG. 5 to the extended position shown in FIG. 6. More particularly, as drawer 52 begins to rise, the inner members 98 also move upwardly causing the nuts 108 on the inner member 98 to engage the notches 114*c* on the upper resilient clips 114 (FIG. 13). In turn, this causes the intermediate member 100 to be pulled up, enabling notches 118*c* on the lower resilient clips 118 to engage the nuts 112 fixed on outer members 102. This engagement is shown in FIG. 9 which shows the full extension of the slide assemblies 54 corresponding to the raised position of the drawer 52, and the open position of the storage compartment 45 shown in FIG. 6. In this open position, the storage compartment 45 may be filled with storage items, such as tackle boxes, or such storage items may be removed. Easy and convenient access to the storage compartment 45 is provided at a convenient location adjacent the cockpit/operator station 30, such access being made from above the deck 34 without requiring the user to bend down and/or reach over into a recessed storage compartment.

When it is desired to return the drawer 52 to the lowered position of FIG. 5, a user gently pushes on the access door 90 causing the slide assemblies 54 to be restored to their retracted position, and the gas struts 55, 56 to move in an over-center manner to their collapsed position to again retain the drawer 52 in the cabinet 50.

Figure 12:
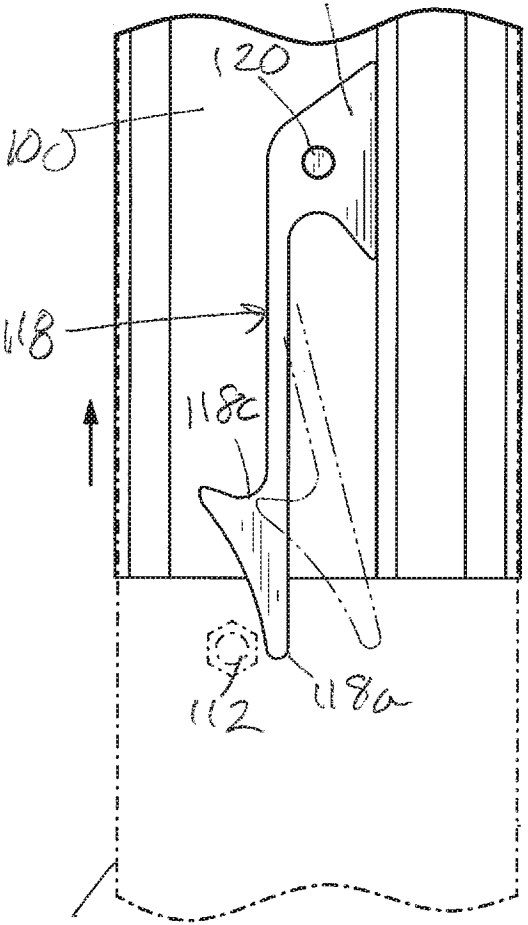
FIGS. 10-12 are diagrams showing a sequence of movement for disassembly of slide arrangement.
Figure 11:
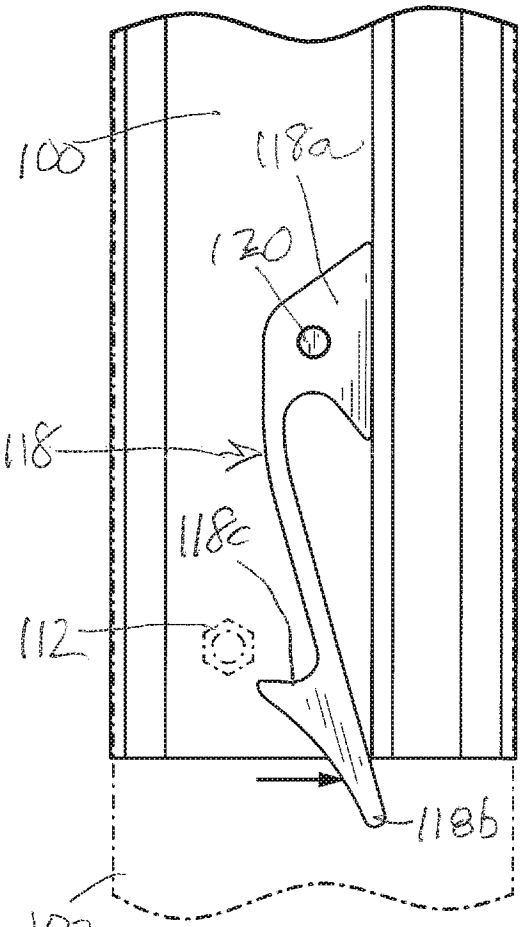
Figure 10:
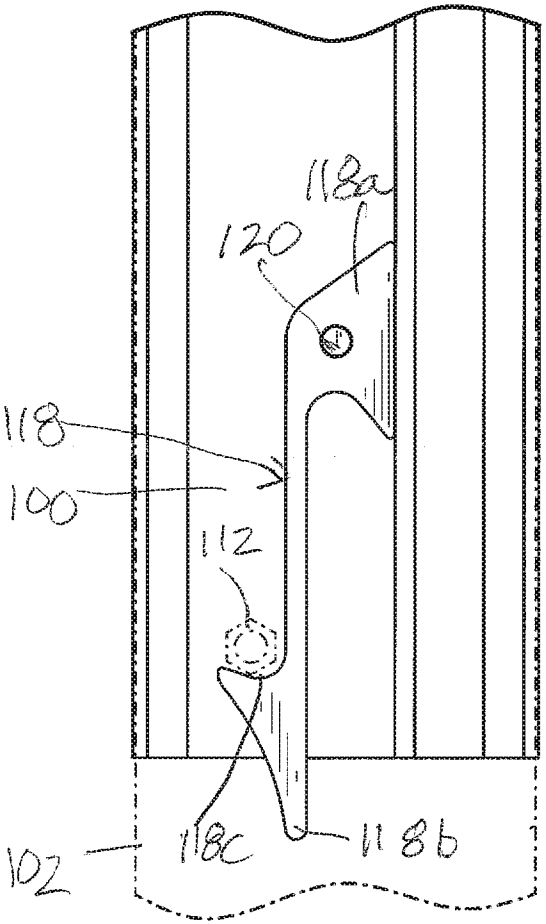
Figure 14:
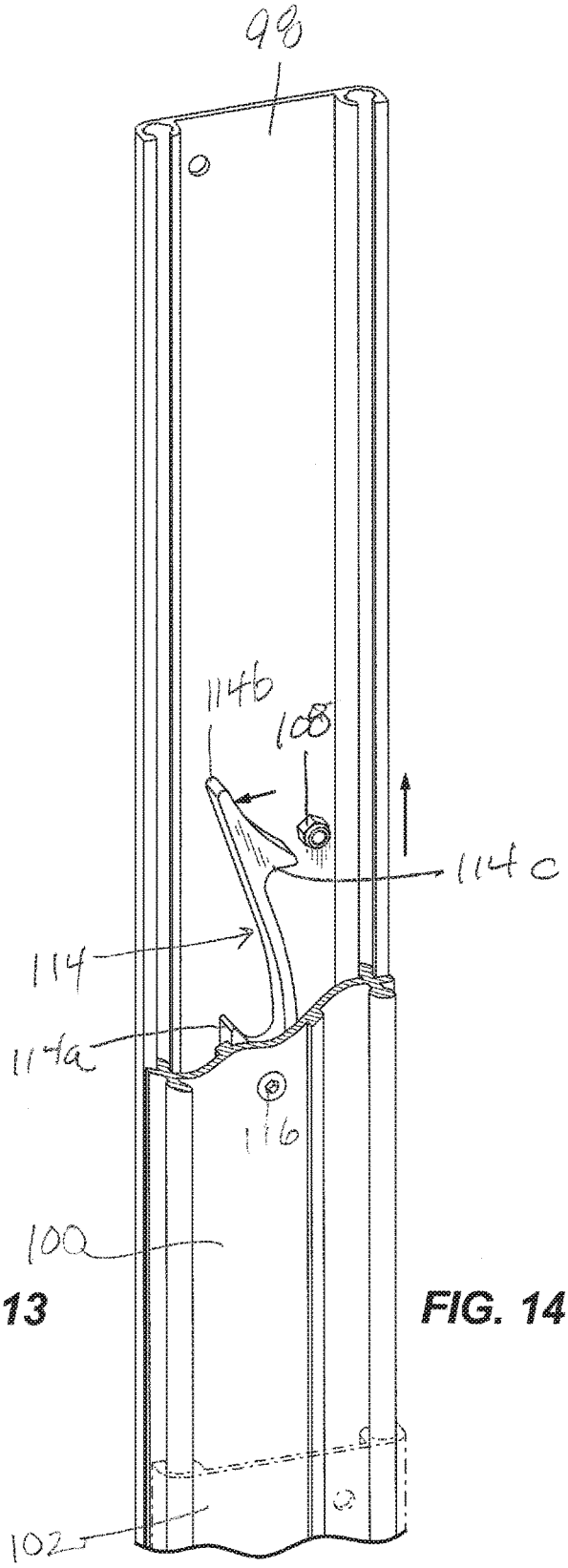
FIG. 14 is a diagram further depicting disassembly of the slide arrangement.

As an auxiliary feature of the present disclosure, if it is desirable or necessary to service the pop up storage system 12, access can be made beneath the deck 34 and beneath the drawer 52 in the raised position FIG. 6. While supporting the drawer 52, the rod ends of the gas struts 55, 56 can be disconnected at 55*b*, 56*b* and the inner members 98 can be unfastened from the outer surfaces of the drawer side panels 78, 80 to enable removal of the drawer 52. Then, as seen in FIG. 14, the upper resilient clips 114 can be manually dislodged from the nuts 108 enabling upward withdrawal of the inner members 98 from the intermediate members 100. Next, as shown in FIGS. 10-12 the lower resilient clips 118 can be manually disengaged from the nuts 112 allowing the intermediate members 100 to be raised out of the outer members 102. Finally, the outer members 102 may be removed by unfastening screws inside the cabinet side walls 60, 62.

The present disclosure thus describes a pop up storage system 12 configured to provide convenient above deck access adjacent the cockpit/operator station 30 using slide assemblies 54 and an over-center biasing arrangement of gas struts 55, 56 to vertically move and automatically retain a drawer forming a storage compartment within a cabinet.

In the present disclosure, certain terms have been used for brevity, clearness, and understanding. No unnecessary limitations are to be implied therefrom beyond the requirement of the prior art because such terms are used for descriptive purposes only and are intended to be broadly construed. The different systems and methods described herein may be used alone or in combination with other systems and devices. Various equivalents, alternatives and modifications are possible within the scope of the appended claims.

What is claimed is:

1. A pop up storage system for a boat having an opening formed in a deck, the storage system comprising:

a cabinet beneath the opening in the deck;

a drawer mounted for vertical sliding movement into and out of the cabinet and defining a storage compartment movable between an open position and a closed position; and a motion assistance arrangement extending between the cabinet and the drawer, and configured for assisting in movement of the drawer relative to the cabinet between a raised position and a lowered position;

wherein the cabinet includes a rear wall, a pair of opposed walls, a front wall and a recessed mounting surface extending between the rear wall and the front wall;

wherein the drawer includes a base, a pair of opposed side panels and an access door extending across and fixed to upper ends of the opposed side panels;

wherein the motion assistance arrangement includes a pair of gas struts extending between the recessed mounting surface of the cabinet and a lower surface of the base, the gas struts having rods which are moveable between an extended position and a retracted position; and wherein a first one of the gas struts has a casing end pivotally secured about a first fixed pivot axis to the recessed mounting surface and a rod end pivotally secured about a first movable pivot axis to the lower surface of the base, and a second one of the gas struts has a casing end pivotally secured about a second fixed pivot axis to the recessed mounting surface and a rod end pivotally secured about a second movable pivot axis to the lower surface of the base.

2. The system of claim 1, wherein the motion assistance arrangement is configured to automatically retain the drawer within the cabinet in the lowered position.

3. The system of claim 1, wherein the recessed mounting surface lies beneath a lower surface of the base when the drawer is in the lowered position.

4. The system of claim 1, wherein the gas struts in the extended position thereof are angularly disposed relative to one another within the cabinet.

5. The system of claim 1, wherein the gas struts in the retracted position thereof lie substantially parallel to one another on the recessed mounting surface.

6. The system of claim 1, wherein the gas struts are oriented in the retracted position thereof within the recessed mounting surface to prevent movement of the drawer relative to the cabinet.

7. The system of claim 1, wherein the gas struts define an over-center biasing arrangement configured for assisting movement of the drawer between the raised position and the lowered position.

8. The system of claim 1, including a slide arrangement positioned between the cabinet and the drawer on opposite sides thereof and configured to establish an upper travel limit of the drawer in the raised position within the cabinet.

9. The system of claim 1, wherein the drawer in the raised position provides access to the storage compartment from above the deck.

* * * * *